US011945679B2

(12) United States Patent
Chen

(10) Patent No.: US 11,945,679 B2
(45) Date of Patent: Apr. 2, 2024

(54) IMAGE FORMING APPARATUS INCLUDING SHEET CASSETTE AND CAPABLE OF PROVIDING STABILIZED CONVEYING PERFORMANCE OF SHEET POSITIONED IN SHEET CASSETTE

(71) Applicant: BROTHER KOGYO KABUSHIKI KAISHA, Nagoya (JP)

(72) Inventor: Wen Chen, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 108 days.

(21) Appl. No.: 17/411,846

(22) Filed: Aug. 25, 2021

(65) Prior Publication Data

US 2022/0063942 A1 Mar. 3, 2022

(30) Foreign Application Priority Data

Aug. 28, 2020 (JP) ..... 2020-144717

(51) Int. Cl.
*B65H 1/26* (2006.01)
*B65H 3/06* (2006.01)
*B65H 5/06* (2006.01)

(52) U.S. Cl.
CPC ..... *B65H 5/062* (2013.01); *B65H 2403/40* (2013.01); *B65H 2405/1142* (2013.01)

(58) Field of Classification Search
CPC ..... B65H 1/266; B65H 1/04; B65H 2403/40; B65H 2403/422; B65H 2405/1142; B65H 3/0669; B65H 5/062
See application file for complete search history.

(56) References Cited

U.S. PATENT DOCUMENTS 6,578,840 B1 * 6/2003 Kudo ..... B65H 3/0669 271/10.08
2011/0233846 A1 * 9/2011 Miwa ..... B65H 5/062 271/10.13
2015/0091242 A1 4/2015 Hashimoto
2017/0075279 A1 3/2017 Hayakawa

FOREIGN PATENT DOCUMENTS

JP 61-106371 A 5/1986
JP 2015-067421 A 4/2015
JP 2017-057051 A 3/2017

* cited by examiner

*Primary Examiner* — Luis A Gonzalez
(74) *Attorney, Agent, or Firm* — Merchant & Gould P.C.

(57) ABSTRACT

An image forming apparatus including a housing, a sheet cassette, a second roller, a gear train, a pendulum gear, and a stop member. The gear train includes a gear rotatable together with the second roller. The pendulum gear is movable between a meshing position where the pendulum gear is in meshing engagement with the gear train and a separated position where the pendulum gear is separated away from the gear train. The stop member allows the pendulum gear to move from the separated position to the meshing position. In the state where the sheet cassette is at an internal position and the stop member is at the second position, the stop member is out of contact with a part of the sheet cassette in a first direction but contacts the part of the sheet cassette in a second direction.

17 Claims, 13 Drawing Sheets

IMAGE FORMING APPARATUS INCLUDING SHEET CASSETTE AND CAPABLE OF PROVIDING STABILIZED CONVEYING PERFORMANCE OF SHEET POSITIONED IN SHEET CASSETTE

CROSS REFERENCE TO RELATED APPLICATION

This application claims priority from Japanese Patent Application No. 2020-144717 filed Aug. 28, 2020. The entire content of the priority application is incorporated herein by reference.

TECHNICAL FIELD

The present disclosure relates to an image forming apparatus, and more particularly, to such image forming apparatus including a stop member associated with a sheet cassette.

BACKGROUND

There has been known an image forming apparatus including a body frame, a sheet cassette including a first roller, a second roller, a gear train, a pendulum gear, and a stop member as described in US Patent Application Publication No. 2017/0075279A1.

The sheet cassette includes a sheet accommodating portion in which a sheet stack is accommodatable. The sheet cassette is movable between an internal position where the sheet cassette is positioned inside the body frame and an external position where the sheet cassette is positioned outside the body frame.

The second roller contacts the first roller when the sheet cassette is at the internal position. The second roller is configured to convey a sheet in the sheet cassette in cooperation with the first roller.

The gear train includes a gear rotatable together with the second gear. The pendulum gear is movable between a meshing position where the pendulum gear is meshingly engaged with the gear train and a separated position where the pendulum gear is positioned away from the gear train.

The stop member is at a first position in a state where the sheet cassette is at the external position. The stop member at its first position retains the pendulum gear at the separated position. The stop member is pivotally moved from the first position to a second position by being pressed by a part of the sheet cassette moving from the external position to the internal position. The stop member at its second position allows the pendulum gear to be moved from the separated position to the meshing position.

SUMMARY

With the conventional image forming apparatus described above, the stop member contacts a part of the sheet cassette in a direction from the internal position to the external position in a state where the sheet cassette is at the internal position and the stop member is at the second position.

Therefore, reaction force directing in the direction from the internal position to the external position is applied from the stop member to the sheet cassette in the state where the sheet cassette is at the internal position and the stop member is at the second position. In other words, the reaction force from the stop member is applied to the sheet cassette in a separating direction of the first roller away from the second roller. Hence, sheet conveying performance by the first roller and the second roller may become unstable.

In view of the foregoing, it is an object of the disclosure to provide an image forming apparatus capable of providing stabilized conveying performance of the sheet positioned in the sheet cassette.

In order to attain the above and other objects, according to one aspect, the disclosure provides an image forming apparatus including a housing, a sheet cassette, a second roller, a gear train, a pendulum gear, and a stop member. The sheet cassette is movable in a first direction between an internal position and an external position. The sheet cassette includes a sheet accommodating portion and a first roller. The sheet accommodating portion is configured to accommodate therein a sheet. The sheet accommodating portion is positioned inside the housing in a state where the sheet cassette is at the internal position. The sheet accommodating portion is positioned outside the housing in a state where the sheet cassette is at the external position. The second roller contacts the first roller in the state where the sheet cassette is at the internal position and is configured to convey the sheet positioned in the sheet cassette in cooperation with the first roller. The gear train includes a gear rotatable together with the second roller. The pendulum gear is movable between a meshing position where the pendulum gear is in meshing engagement with the gear train and a separated position where the pendulum gear is separated away from the gear train. The stop member is configured to be moved from a first position to a second position in a second direction crossing the first direction by being pressed by a part of the sheet cassette moving from the external position to the internal position. The stop member is at the first position in the state where the sheet cassette is at the external position. The stop member retains the pendulum gear at the separated position in a state where the stop member is at the first position. The stop member allows the pendulum gear to move from the separated position to the meshing position in a state where the stop member is at the second position. In the state where the sheet cassette is at the internal position and the stop member is at the second position, the stop member is out of contact with the part of the sheet cassette in the first direction but contacts the part of the sheet cassette in the second direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
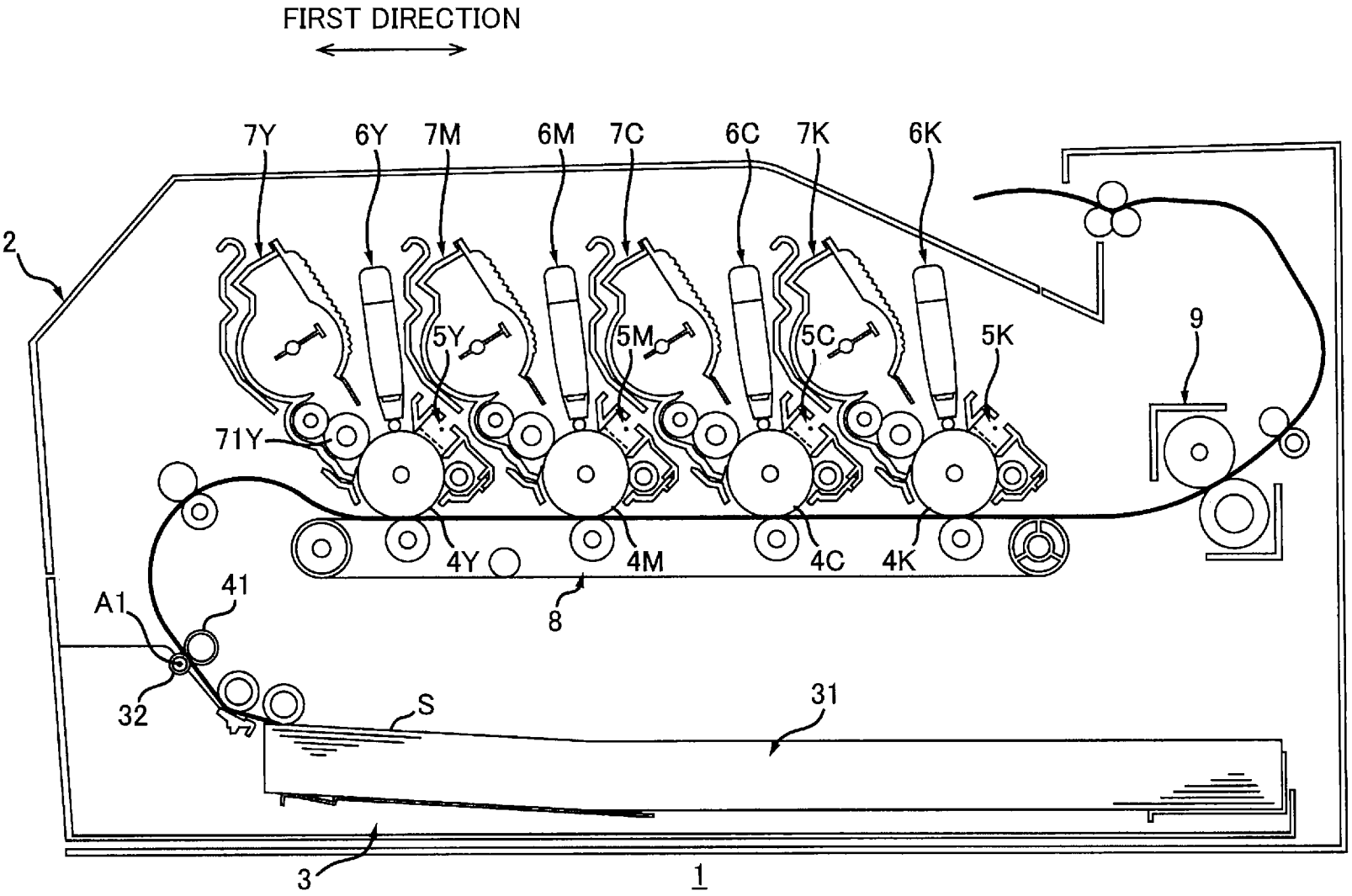
FIG. 1 is a schematic view of the image forming apparatus according to one embodiment.

An image forming apparatus 1 according to one embodiment of the present disclosure will be described with reference to the accompanying drawings.

1. Overall Structure of Image Forming Apparatus 1

An overall structure of the image forming apparatus 1 will be described with reference to FIG. 1. The image forming apparatus 1 includes a housing 2, a sheet cassette 3, a plurality of photosensitive drums 4Y, 4M, 4C, 4K, a plurality of chargers 5Y, 5M, 5C, 5K, a plurality of exposure units 6Y, 6M, 6C, 6K, a plurality of developing units 7Y, 7M, 7C, 7K, a transfer unit 8, and a fixing unit 9.

1.1 Housing 2

The housing 2 constitutes an outer shell of the image forming apparatus 1. The housing 2 accommodates therein the sheet cassette 3, the photosensitive drums 4Y, 4M, 4C, 4K, the chargers 5Y, 5M, 5C, 5K, the exposure units 6Y, 6M, 6C, 6K, the developing units 7Y, 7M, 7C, 7K, the transfer unit 8, and the fixing unit 9.

1.2 Sheet Cassette 3

The sheet cassette 3 is configured to accommodate therein a stack of sheets S. The sheet S such as a printing sheet in the sheet cassette 3 is conveyed toward the transfer unit 8.

1.3 Photosensitive Drums 4Y, 4M, 4C, 4K

The photosensitive drum 4Y is rotatable about a drum axis extending in an axial direction. The photosensitive drum 4Y extends along the drum axis. The photosensitive drums 4Y, 4M, 4C, 4K are arrayed with each other in a first direction. The first direction crosses the axial direction. Preferably, the first direction is perpendicular to the axial direction. Each of the photosensitive drums 4M, 4C, 4K is the same as the photosensitive drum 4Y, and therefore, further description will be omitted.

1.4 Chargers 5Y, 5M, 5C, 5K

The chargers 5Y, 5M, 5C, 5K are configured to charge surfaces of the photosensitive drums 4Y, 4M, 4C, 4K, respectively. Each of the chargers 5Y, 5M, 5C, 5K is a scorotron charger in the present embodiment. However, a charging roller is also available.

1.5 Exposure Units 6Y, 6M, 6C, 6K

The exposure units 6Y, 6M, 6C, 6K are configured to expose the photosensitive drums 4Y, 4M, 4C, 4K to lights, respectively. Each of the exposure units 6Y, 6M, 6C, 6K is an LED unit including an LED array in the present embodiment. However, instead of the exposure units 6Y, 6M, 6C, 6K, a laser scanning unit is available.

1.6 Developing Units 7Y, 7M, 7C, 7K

The developing unit 7Y is configured to supply toner to the photosensitive drum 4Y. The developing unit 7Y includes a developing roller 71Y. The developing roller 71Y is rotatable about a developing axis extending in the axial direction. The developing roller 71Y extends along the developing axis. In the present embodiment, the developing roller 71Y is in contact with the photosensitive drum 4Y. However, the developing roller 71Y may be contactable with and separable from the photosensitive drum 4Y. The developing units 7M, 7C, 7K are the same as the developing unit 7Y, and therefore, further description will be omitted.

1.7 Transfer Unit 8

The transfer unit 8 is configured to transfer toners carried on the photosensitive drums 4Y, 4M, 4C, 4K to the sheet S.

1.8 Fixing Unit 9

The fixing unit 9 is configured to heat and press the sheet S on which the toner is transferred to fix the toner to the sheet S. The sheet S moved past the fixing unit 9 is discharged outside of the housing 2.

2. Details of Sheet Cassette 3

Details of the sheet cassette 3 will be described with reference to FIGS. 1 through 4. The sheet cassette 3 is movable in the first direction between an internal position (see FIG. 1) and an external position (see FIG. 2). The sheet cassette 3 includes a sheet accommodating portion 31 (see FIG. 1), a first roller 32 (see FIG. 1), and a rib 33 (see FIG. 3).

2.1 Sheet Accommodating Portion 31

Figure 2:
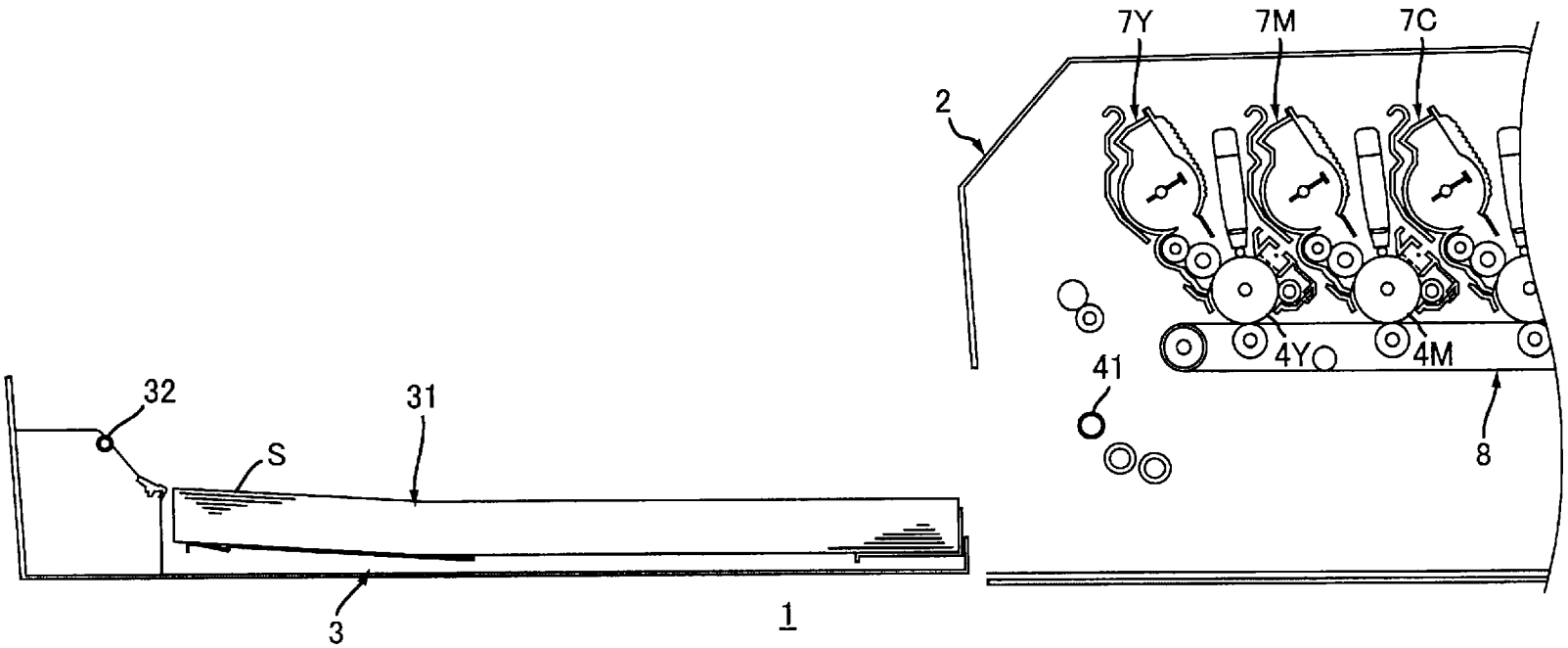
FIG. 2 is a partial schematic view of the image forming apparatus and particularly illustrating a state where a sheet cassette is at an external position.
Figure 3:
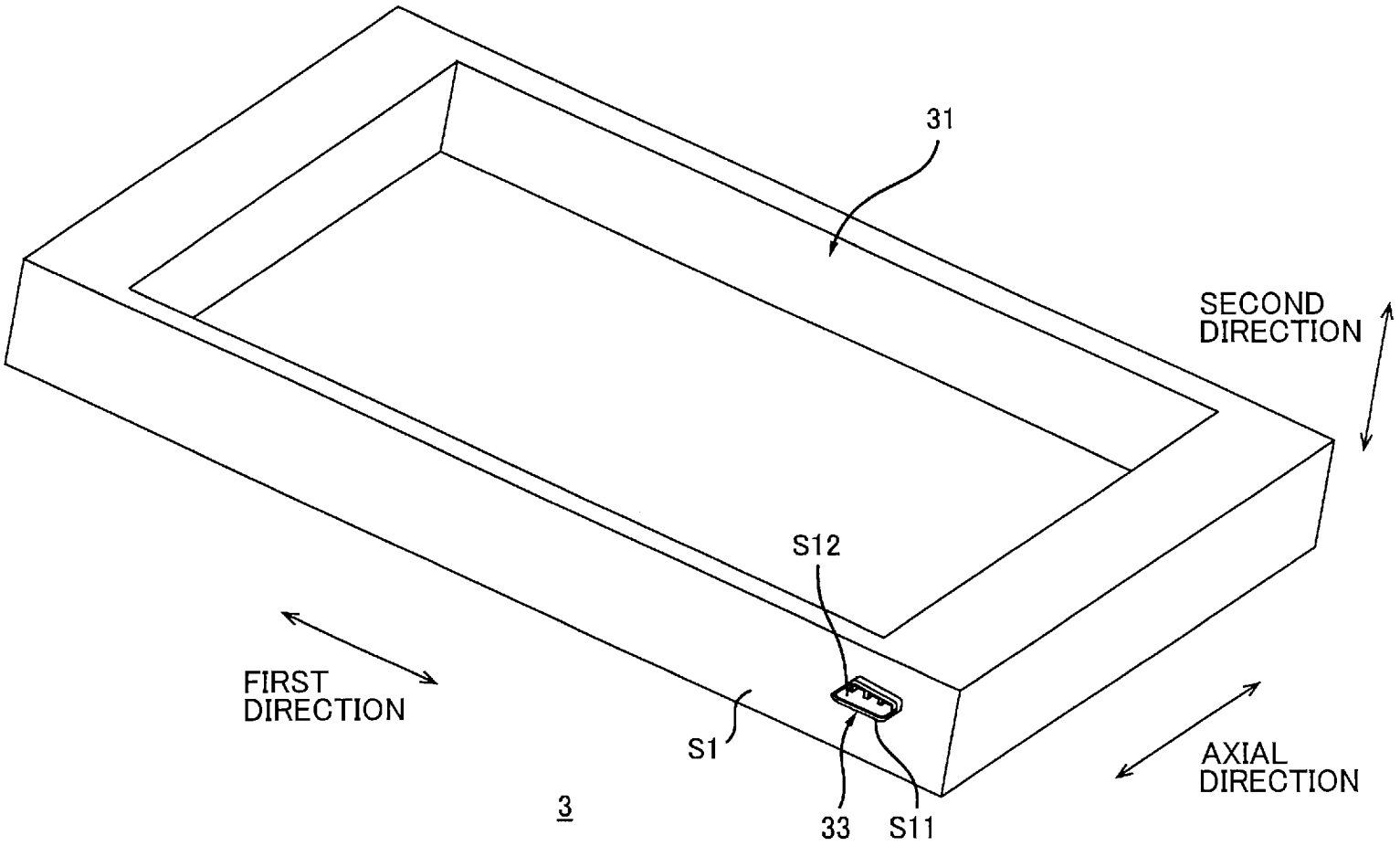
FIG. 3 is a perspective view of the sheet cassette in the image forming apparatus according to the embodiment.

As illustrated in FIG. 1, the sheet accommodating portion 31 is configured to accommodate therein the sheets S. The sheet accommodating portion 31 in its entirety is positioned inside the housing 2 when the sheet cassette 3 is at the internal position. As illustrated in FIG. 2, at least a part of the sheet accommodating portion 31 is positioned outside of the housing 2 when the sheet cassette 3 is at the external position. As illustrated in FIG. 3, the sheet accommodating portion 31 has a tray like shape.

2.2 First Roller 32

As illustrated in FIG. 1, the first roller 32 is rotatable about a roller axis A1 extending in the axial direction. The first roller 32 extends along the roller axis A1.

2.3 Rib 33

Figure 4:
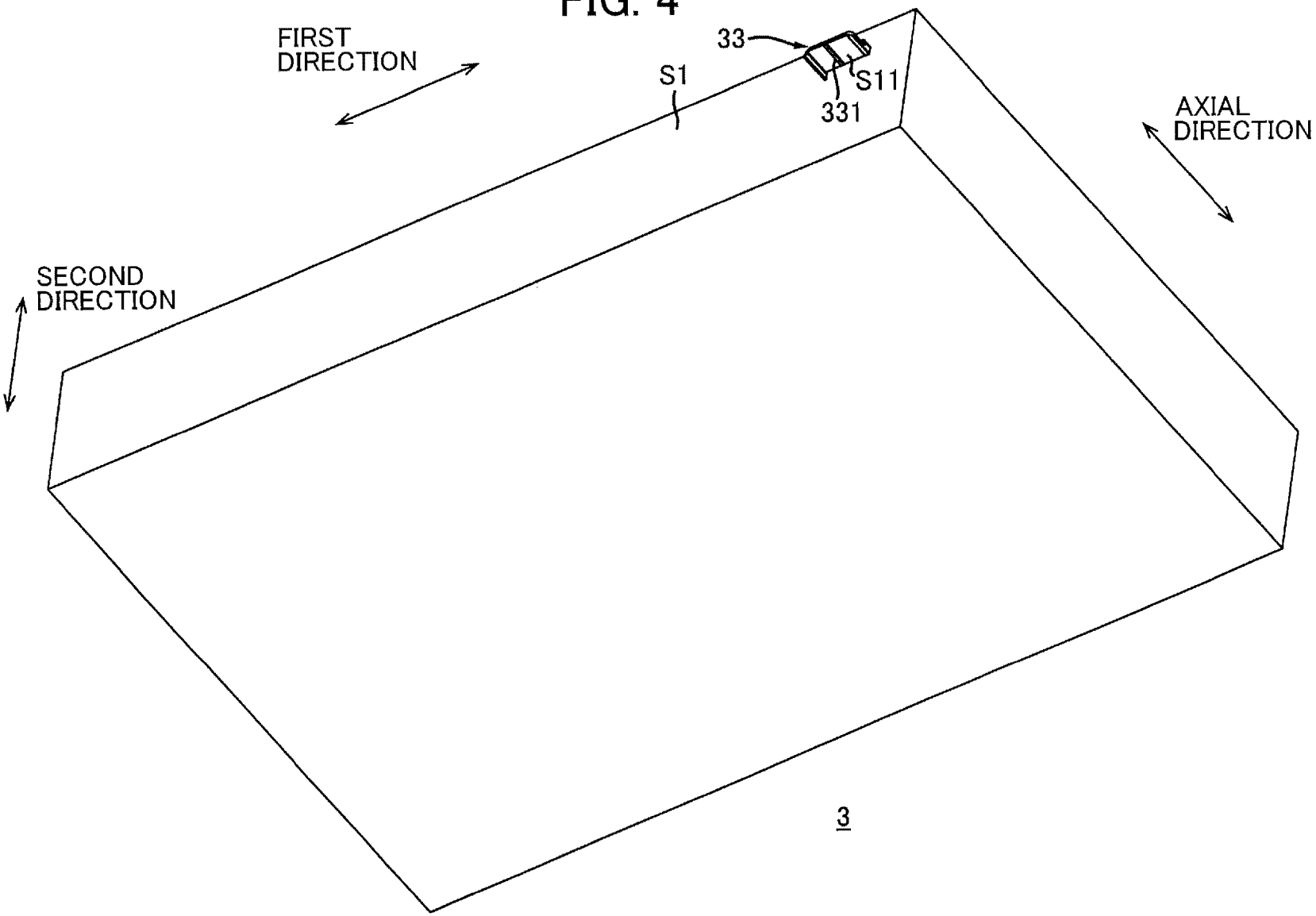
FIG. 4 is another perspective view of the sheet cassette as viewed in a direction different from the viewing direction in FIG. 3.

As illustrated in FIG. 3, the rib 33 is positioned at a side surface S1 in the axial direction of the sheet cassette 3. The rib 33 protrudes from the side surface S1 in the axial direction and extends in the first direction. The rib 33 may be integral with the sheet cassette 3, or may be attached to the side surface S1. The rib 33 has one surface S11 and another surface S12 in a second direction. The second direction crosses the axial direction and the first direction. Preferably, the second direction is perpendicular to the axial direction and the first direction. As illustrated in FIG. 4, the rib 33 includes a protrusion 331.

The protrusion 331 is positioned on the one surface S11. That is, the protrusion 331 protrudes from the one surface S11 in the second direction and extends in the axial direction. The protrusion 331 may be integral with the one surface S11 or may be attached to the one surface S11.

3. Details of Image Forming Apparatus

Details of the image forming apparatus 1 will be described with reference to FIGS. 1 through 3, and 5 through 13. The image forming apparatus 1 further includes a second roller 41 (see FIG. 1), a side frame 42 (see FIG. 5), a gear train 43 (see FIG. 10A), a gear 44 (see FIG. 10A), a pendulum gear 45 (see FIG. 10A), a stop member 46 (see FIG. 7), and a spring 47 (see FIG. 7).

3.1 Second Roller 41

As illustrated in FIG. 1, the second roller 41 contacts the first roller 32 when the sheet cassette 3 is at the internal position. The second roller 41 is configured to convey the sheet S positioned in the sheet cassette 3 toward the transfer unit 8 in cooperation with the first roller 32.

3.2 Side Frame 42

Figure 5:
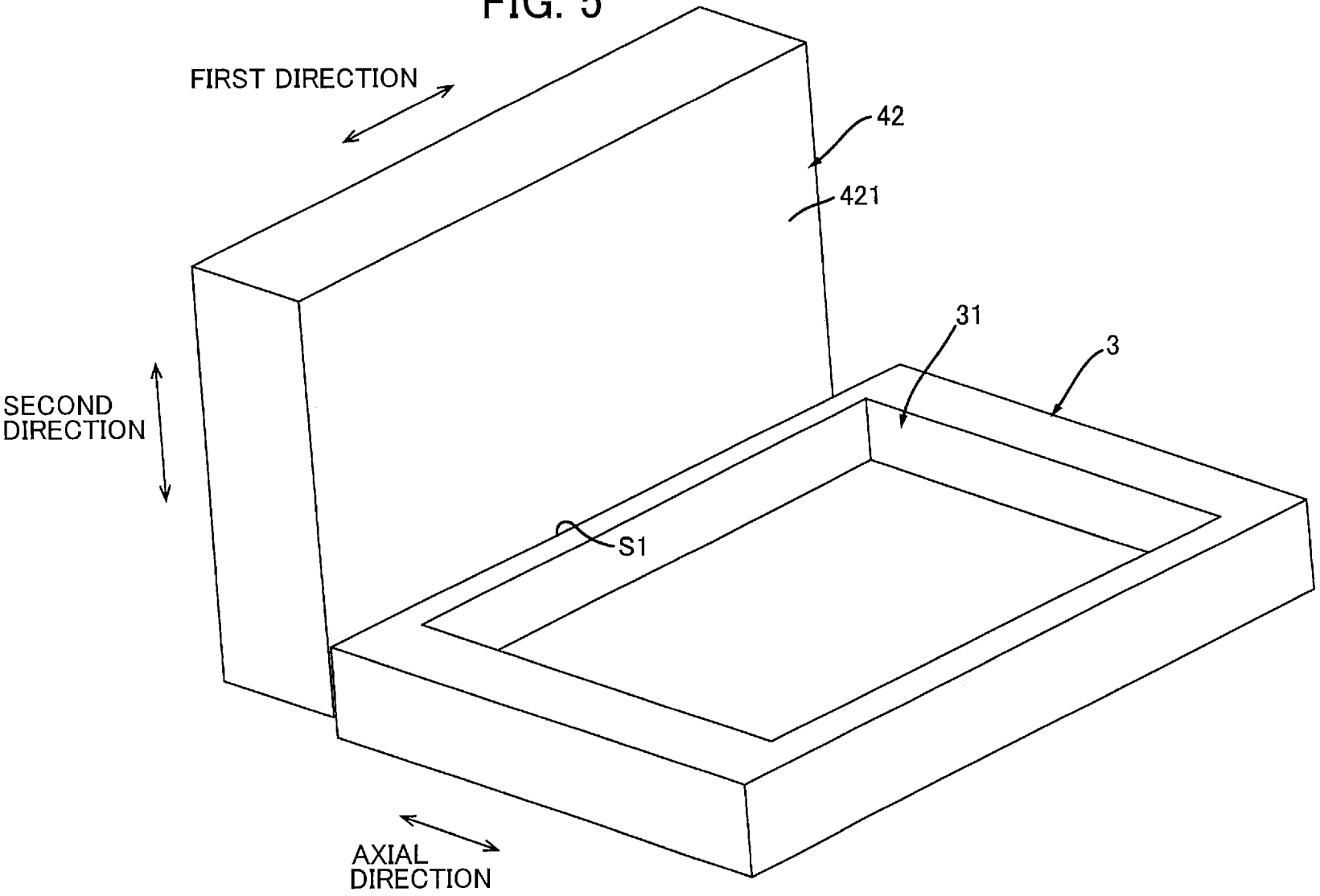
FIG. 5 is a perspective view illustrating a first side frame and the sheet cassette positioned at an internal position in the image forming apparatus according to the embodiment.

As illustrated in FIG. 5, the side frame 42 faces the side surface S1 of the sheet cassette 3 when the sheet cassette 3 is at the internal position. The side frame 42 is positioned inside the housing 2. The side frame 42 extends in the first direction and the second direction. The side frame 42 supports one end portion of the side frame 42. The side frame 42 also supports the gear train 43, the gear 44, the pendulum gear 45, the stop member 46, and the spring 47.

Figure 6:
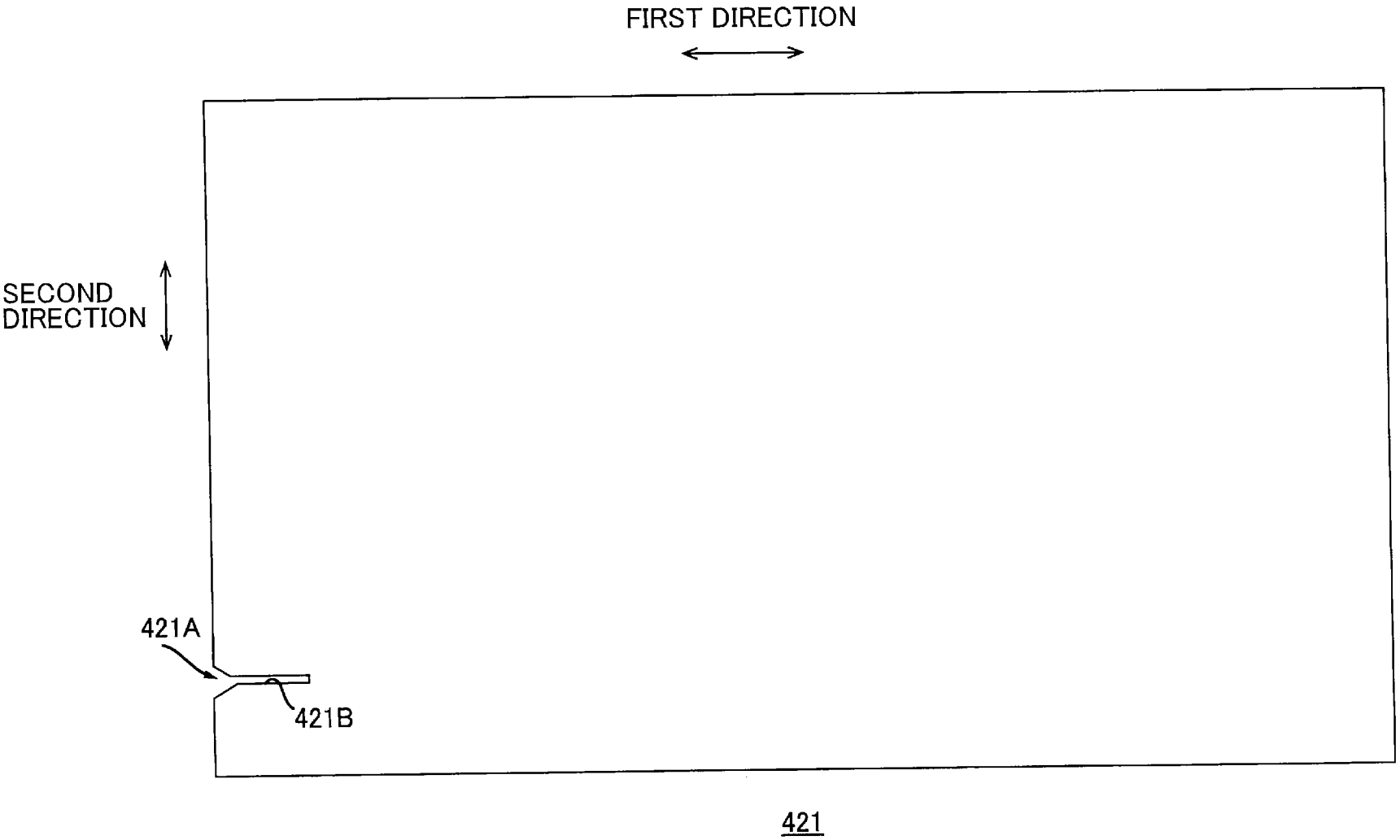
FIG. 6 is a side view of the first side frame as viewed in an axial direction.
Figure 7:
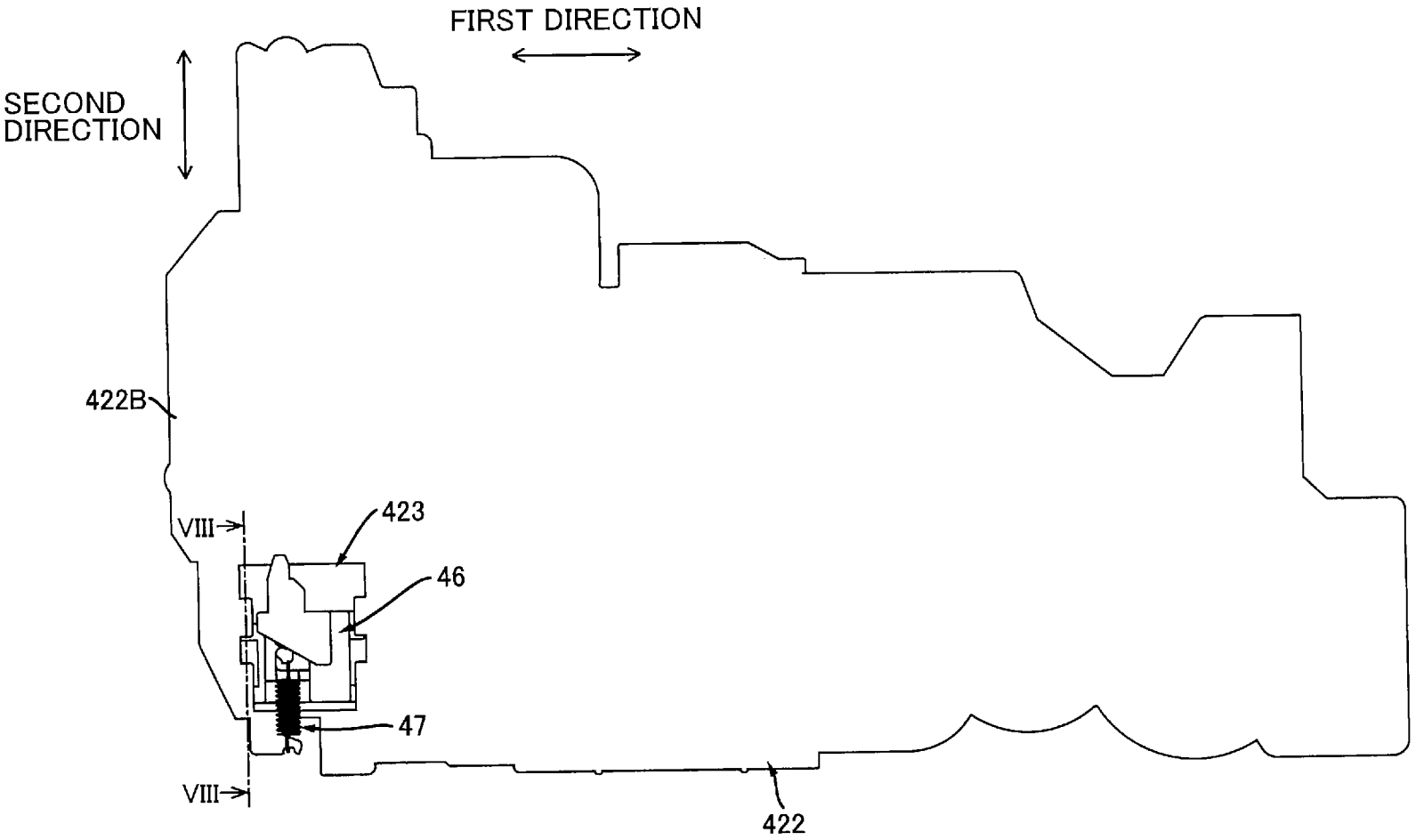
FIG. 7 is a side view of a second side frame as viewed in the axial direction in the image forming apparatus according to the embodiment.

Specifically, the side frame 42 includes a first side frame 421 (see FIG. 6) and a second side frame 422 (see FIG. 7). In other words, the image forming apparatus 1 includes the first side frame 421 and the second side frame 422.

3.2.1 First Side Frame 421

As illustrated in FIG. 5, the first side frame 421 extends in the first direction and the second direction. The first side frame 421 faces the side surface S1 of the sheet cassette 3 when the sheet cassette 3 is at the internal position. As illustrated in FIG. 6, the first side frame 421 is formed with a groove 421A having a receiving surface 421B. The groove 421A extends in the axial direction and recessed in the first direction. The rib 33 of the sheet cassette 3 is fitted with the groove 421A when the sheet cassette 3 is at the internal position.

The receiving surface 421B is an inner surface of the groove 421A. The receiving surface 421B is coincident with a lower horizontal line of the rib 33 illustrated in FIG. 11B. The receiving surface 421B receives the rib 33 when the sheet cassette 3 is at the internal position. Specifically, the protrusion 331 of the rib 33 contacts the receiving surface 421B when the sheet cassette 3 is at the internal position. In a case where the sheet cassette 3 is moved between the external position and the internal position, the rib 33 can be smoothly slidingly moved with respect to the receiving surface 421B because of the contact of the protrusion 331 with the receiving surface 421B. Hence, an operator can perform smooth movement of the sheet cassette 3. The receiving surface 421B is positioned opposite to a cam portion 461B (see FIG. 11B) of the stop member 46 with respect to the rib 33 when the sheet cassette 3 is at the internal position. The cam portion 461B will be described later.

3.2.2 Second Side Frame 422

As illustrated in FIG. 7, the second side frame 422 extends in the first direction and the second direction. The second side frame 422 is positioned opposite to the sheet cassette 3 with respect to the first side frame 421 when the sheet cassette 3 is at the internal position. The second side frame 422 supports the gear train 43, the gear 44, the pendulum gear 45, the stop member 46, and the spring 47 in cooperation with the first side frame 421.

Figure 8:
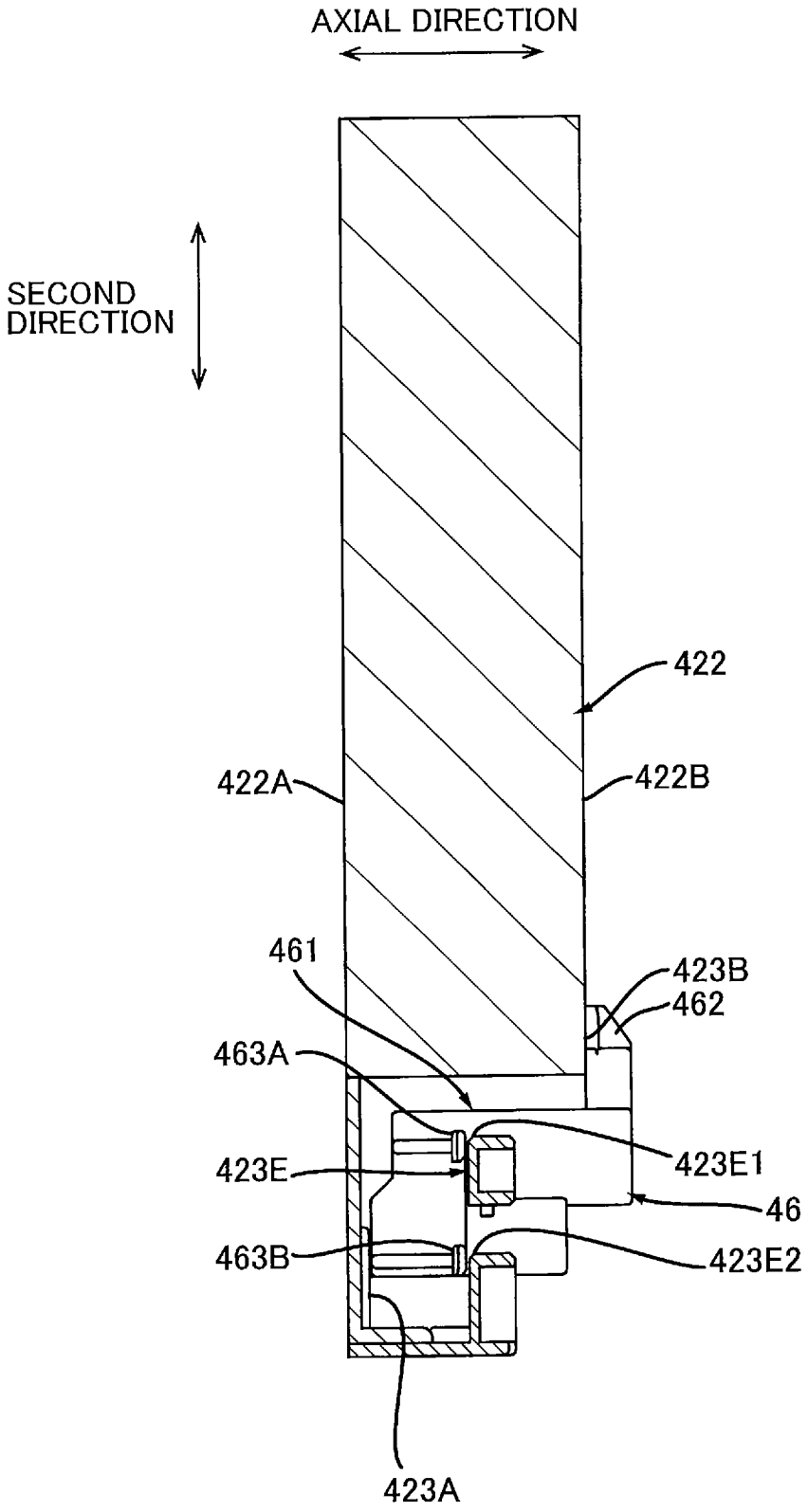
FIG. 8 is a cross-sectional view of the second side frame taken along the line VIII-VIII in FIG. 7.

As illustrated in FIG. 8, the second side frame 422 has a first surface 422A and a second surface 422B. The first surface 422A is positioned apart from the sheet cassette 3 in the axial direction when the sheet cassette 3 is at the internal position. The second surface 422B is positioned between the first surface 422A and the sheet cassette 3 in the axial direction when the sheet cassette 3 is at the internal position.

As illustrated in FIG. 7, the second side frame 422 includes a supporting portion 423. The supporting portion 423 is positioned on the second surface 422B. The supporting portion 423 supports the stop member 46. The supporting portion 423 faces the groove 421A of the first side frame 421 in the axial direction. The supporting portion 423 is positioned opposite to the sheet cassette 3 with respect to the groove 421A when the sheet cassette 3 is at the internal position.

Figure 9:
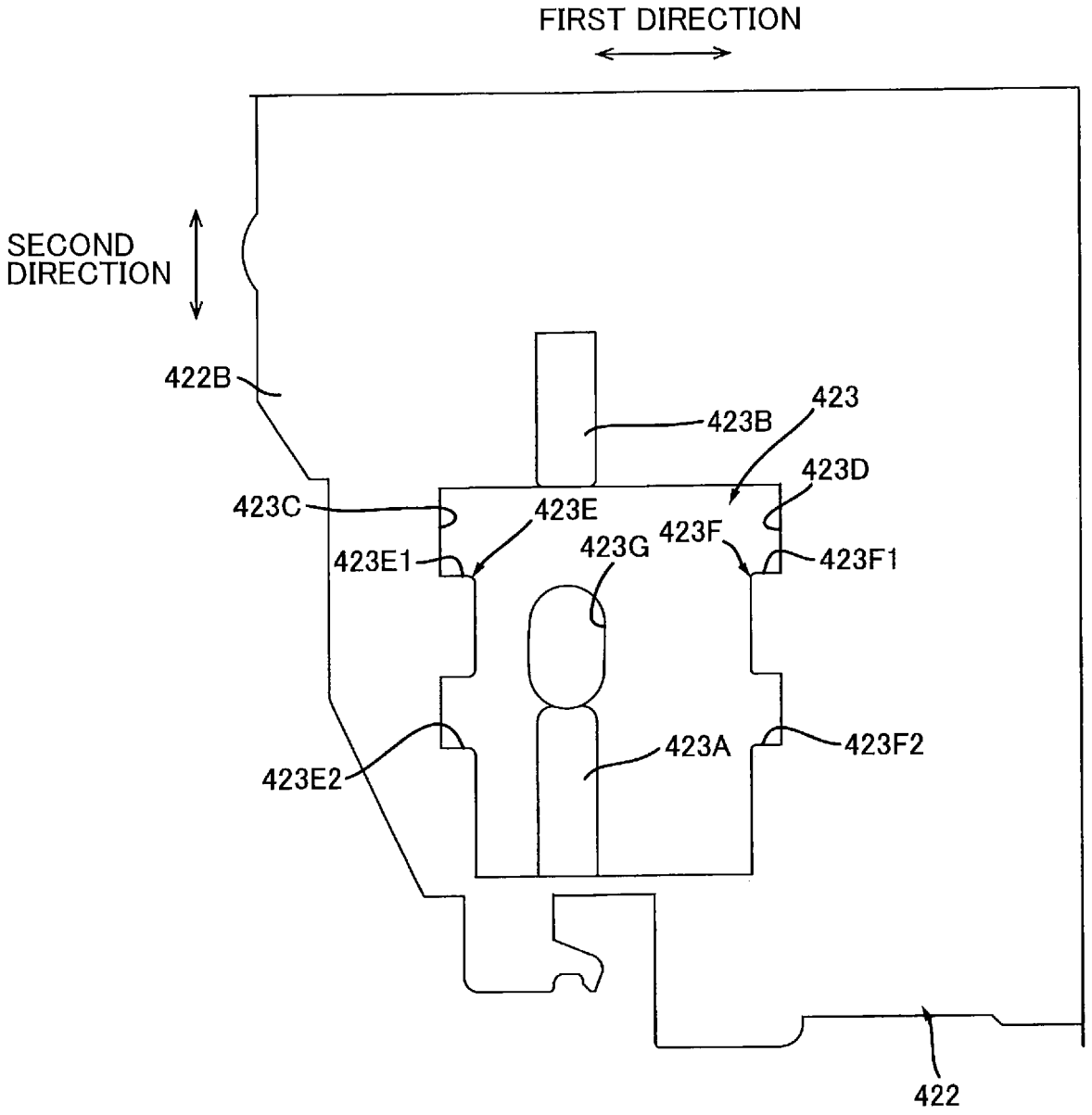
FIG. 9 is an enlarged view of a support portion of the second side frame illustrated in FIG. 7.

As illustrated in FIG. 9, the supporting portion 423 has a first supporting surface 423A, a second supporting surface 423B, a first guide surface 423C, a second guide surface 423D, a first guide rib 423E, and a second guide rib 423F, and is formed with a guide hole 423G.

3.2.2.1 First Supporting Surface 423A

The first supporting surface 423A extends in the first direction and the second direction. The first supporting surface 423A is a flat surface.

3.2.2.2 Second Supporting Surface 423B

The second supporting surface 423B is positioned apart from the first supporting surface 423A in the second direction. The second supporting surface 423B extends in the first direction and the second direction. The second supporting surface 423B is a flat surface. As illustrated in FIG. 8, the second supporting surface 423B is positioned apart from the first supporting surface 423A in the axial direction. The second supporting surface 423B is positioned between the first supporting surface 423A and the first side frame 421 in the axial direction. The second supporting surface 423B is positioned between the first supporting surface 423A and the sheet cassette 3 in the axial direction when the sheet cassette 3 is at the internal position.

3.2.2.3 First Guide Surface 423C

As illustrated in FIG. 9, the first guide surface 423C is positioned apart from the first supporting surface 423A in the first direction. The first guide surface 423C extends in the axial direction and the second direction. In other words, the first guide surface 423C extends in the direction crossing the first supporting surface 423A. Preferably, the first guide surface 423C extends perpendicular to the first supporting surface 423A. The first guide surface 423C guides one end in the first direction of the stop member 46 during movement of the stop member 46 between a first position (see FIG. 11A) and a second position (see FIG. 11B). The first position and the second position will be described later.

3.2.2.4 Second Guide Surface 423D

The second guide surface 423D is positioned opposite to the first guide surface 423C in the first direction with respect to the first supporting surface 423A. The second guide surface 423D is positioned opposite to the first guide surface 423C in the first direction with respect to the stop member 46 in the attached state of the stop member 46 to the second side frame 422. The second guide surface 423D is positioned apart from the first supporting surface 423A in the first direction. the second guide surface 423D extends in the axial direction and the second direction. In other words, the second guide surface 423D extends in the direction crossing the first supporting surface 423A. Preferably, the second guide surface 423D extends perpendicular to the first supporting surface 423A. The second guide surface 423D guides another end in the first direction of the stop member 46 during movement of the stop member 46 between the first position and the second position.

3.2.2.5 First Guide Rib 423E

The first guide rib 423E is positioned on the first guide surface 423C. The first guide rib 423E protrudes from the first guide surface 423C in the first direction and extends in the second direction. The first guide rib 423E is integral with the first guide surface 423C or may be attached to the first guide surface 423C. The first guide rib 423E has a plurality of first notches 423E1, 423E2. The first notches 423E1 and 423E2 are positioned apart from each other in the second direction.

As illustrated in FIG. 8, the first guide rib 423E is positioned apart from the first supporting surface 423A in the axial direction. The first guide rib 423E is positioned between the first supporting surface 423A and the first side frame 421 in the axial direction. In the depicted embodiment, the first guide rib 423E is positioned between the first supporting surface 423A and the second supporting surface 423B in the axial direction.

3.2.2.6 Second Guide Rib 423F

As illustrated in FIG. 9, the second guide rib 423F is positioned on the second guide surface 423D. The second guide rib 423F protrudes from the second guide surface 423D in the first direction and extends in the second direction. The second guide rib 423F is integral with the second guide surface 423D or may be attached to the second guide surface 423D. The second guide rib 423F is positioned apart from the first guide rib 423E in the first direction. The second guide rib 423F has a plurality of second notches 423F1, 423F2. The second notches 423F1 and 423F2 are positioned apart from each other in the second direction.

Similar to the first guide rib 423E, the second guide rib 423F is positioned apart from the first supporting surface 423A in the axial direction. The second guide rib 423F is positioned between the first supporting surface 423A and the first side frame 421 in the axial direction. In the depicted embodiment, the second guide rib 423F is positioned between the first supporting surface 423A and the second supporting surface 423B in the axial direction.

3.2.2.7 Guide Hole 423G

The guide hole 423G guides movement of the pendulum gear 45. The guide hole 423G is positioned between the first guide surface 423C and the second guide surface 423D in the first direction. The guide hole 423G is positioned between the first supporting surface 423A and the second supporting surface 423B in the second direction. The guide hole 423G has oblong shape extending in the second direction. the guide hole 423G is a through-hole. The guide hole 423G guides a shaft 451 (see FIG. 10A) of the pendulum gear 45. The shaft 451 will be described later.

3.3 Gear Train

Figure 10A:
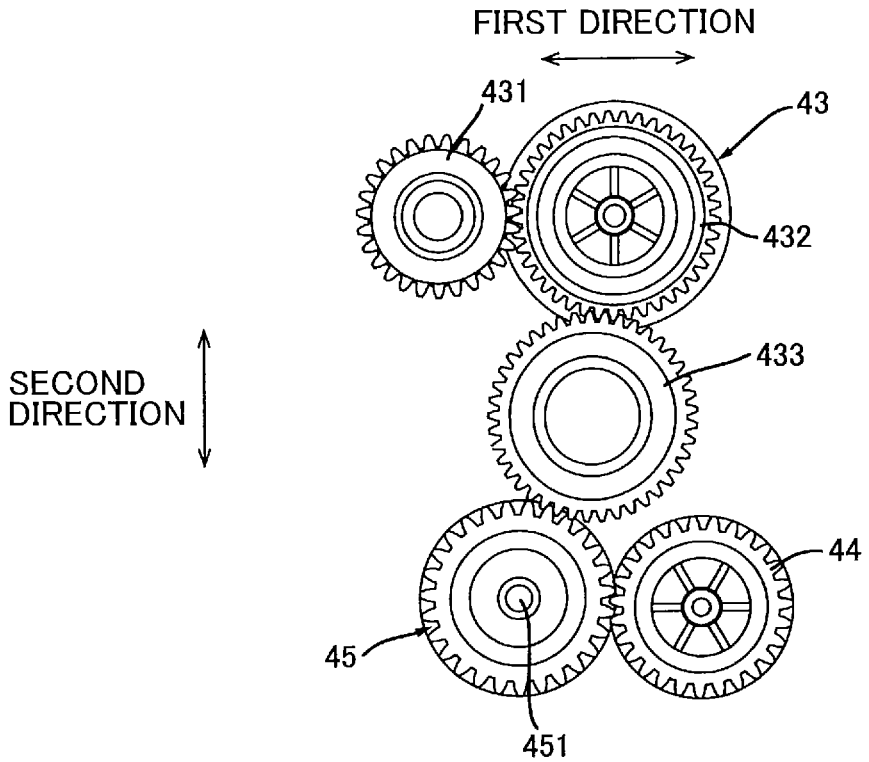
FIG. 10A is a view for description of a gear grain including a pendulum gear in the image forming apparatus according to the embodiment, and particularly illustrating a meshing position of the pendulum gear.

As illustrated in FIG. 10A, the gear train 43 includes a plurality of gears 431, 432, 433. That is, the gear train 43 includes the gear 431. The gear train 43 is positioned on the first surface 422A (FIG. 8) of the second side frame 422. The gear 431 is fixed to one end portion in the axial direction of the second roller 41. The gear 431 is rotatable together with the second roller 41. The gear 432 is in meshing engagement with the gear 431. The gear 433 is in meshing engagement with the gear 432.

3.4 Gear 44

The gear 44 is rotatable upon receiving driving force from a motor (not illustrated).

The gear 44 is positioned on the first surface 422A of the second side frame 422.

3.5 Pendulum Gear 45

Figure 10B:
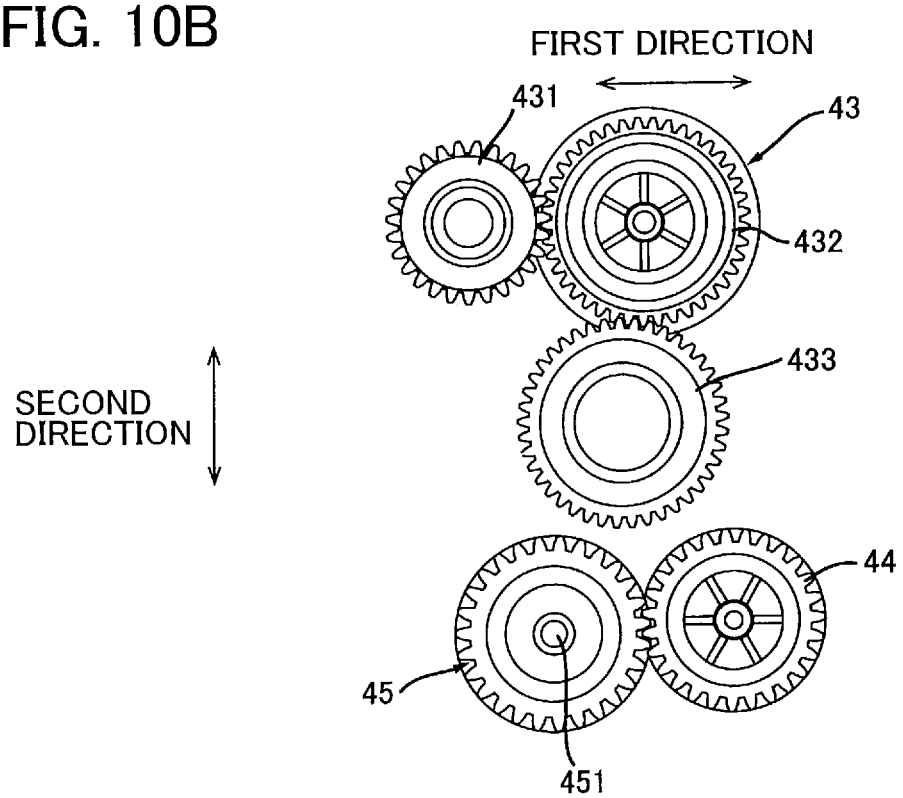
FIG. 10B is a view illustrating the gear grain, and particularly illustrating a separated position of the pendulum gear.

The pendulum gear 45 is in meshing engagement with the gear 44. The pendulum gear 45 is movable between a meshing position illustrated in FIG. 10A and a separated position illustrated in FIG. 10B. When the pendulum gear 45 is at the meshing position, as illustrated in FIG. 10A, the pendulum gear 45 is in meshing engagement with the gear 433 of the gear train 43. Hence, driving force is transmitted from the gear 44 to the gear 433 of the gear train 43 through the pendulum gear 45. On the other hand, when the pendulum gear 45 is at the separated position, as illustrated in FIG. 10B the pendulum gear 45 is separated away from the gear train 43. Hence, power transmission from the gear 44 to the gear train 43 is cut-off. The pendulum gear 45 is positioned on the first surface 422A of the second side frame 422. The pendulum gear 45 includes the shaft 451 extending in the axial direction. The shaft 451 is inserted through the guide hole 423G of the second side frame 422.

3.6 Stop Member 46

As illustrated in FIG. 8, the stop member 46 is positioned on the second surface 422B of the second side frame 422. The stop member 46 is movable between the first position illustrated in FIG. 11A and the second position illustrated in FIG. 11B. The stop member 46 is at the first position when the sheet cassette 3 is at the external position. The stop member 46 retains the pendulum gear 45 at the separated position when the stop member 46 is at the first position.

The stop member 46 is configured to be moved from the first position to the second position in the second direction by being pressed by the part of the sheet cassette 3 moving from the external position to the internal position. Specifically, the part of the sheet cassette 3 is the rib 33 (FIG. 3). The stop member 46 is pushed by the rib 33 of the sheet cassette 3 moving from the external position to the internal position, so that the stop member 46 is moved from the first position to the second position. More specifically, the rib 33 presses against a sloped surface S22 of the cam portion 461B of the stop member 46 in accordance with the movement of the sheet cassette 3 from the external position to the internal position. Details of the cam portion 461B will be described below. The stop member 46 is linearly movable in the second direction between the first position and the second position.

Figure 11B:
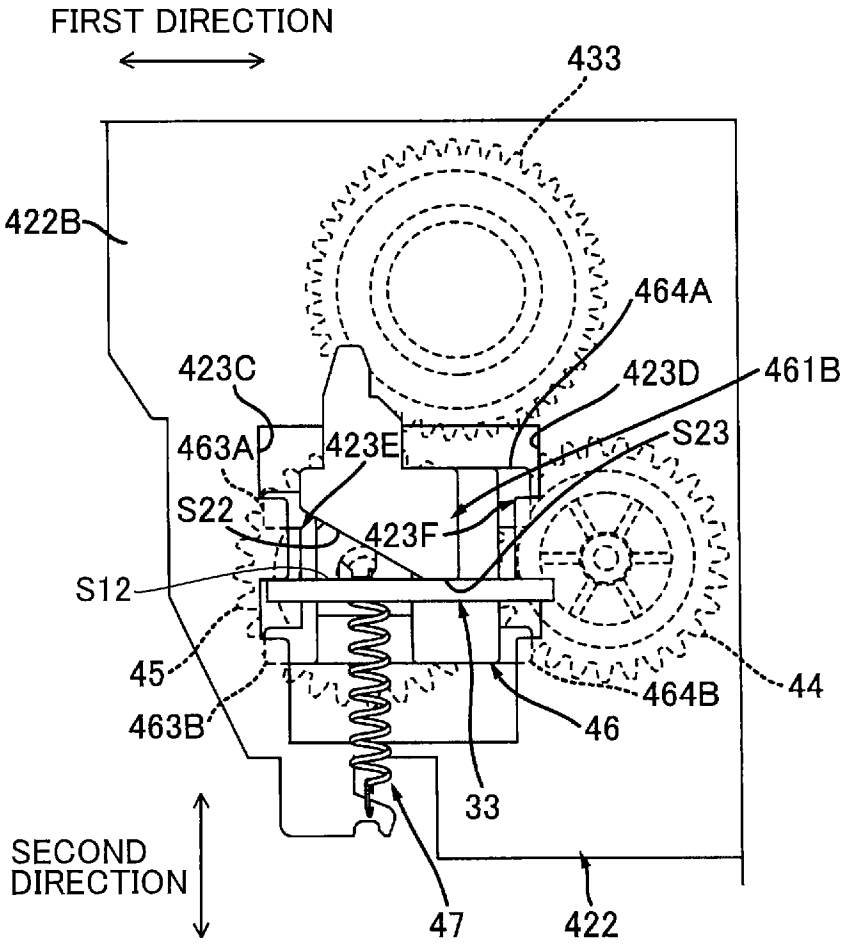
FIG. 11B is a view for description of movement of the stop member, and particularly illustrating the stop member positioned at a second position.

As illustrated in FIG. 11B, the stop member 46 allows the pendulum gear 45 to move from the separated position to the meshing position when the stop member 46 is at the second position. Hence, the pendulum gear 45 is moved from the separated position to the meshing position by the driving force from the gear 44 rotated by the driving force from the motor when the stop member 46 is at the second position.

Here, the cam portion 461B of the stop member 46 contacts the rib 33 in the second direction in the state where the sheet cassette 3 is at the internal position and the stop member 46 is at the second position. That is, the cam portion 461B contacts the other surface S12 (FIG. 3) in the second direction of the rib 33. In this state, the stop member 46 does not contact the rib 33 in the first direction. Hence, the stop member 46 does not press against the rib 33 in the first direction. Consequently, the stop member 46 does not urge the sheet cassette 3 in a departing direction of the first roller 32 away from the second roller 41 when the sheet cassette 3 is at the internal position. As a result, the sheet S in the sheet cassette 3 can be stably conveyed toward the transfer unit 8 by the cooperation of the first roller 32 and the second roller 41.

Figure 12A:
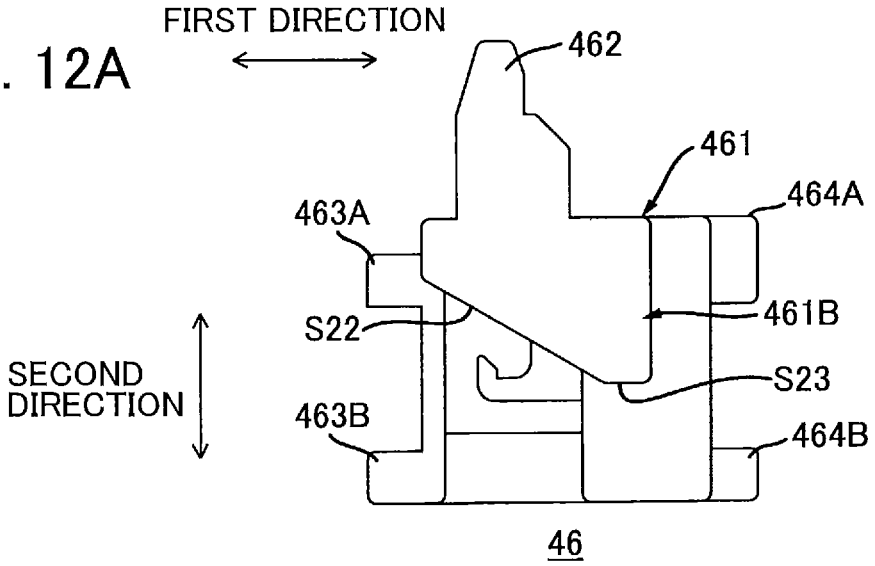
FIG. 12A is a side view of the stop member illustrated in FIG. 11A as viewed in the axial direction.

As illustrated in FIG. 12A, the stop member 46 includes a stop body 461, a first protrusion 462, a plurality of second protrusions 463A, 463B, and a plurality of third protrusions 464A, 464B.

3.6.1 Stop Body 461

Figure 12B:
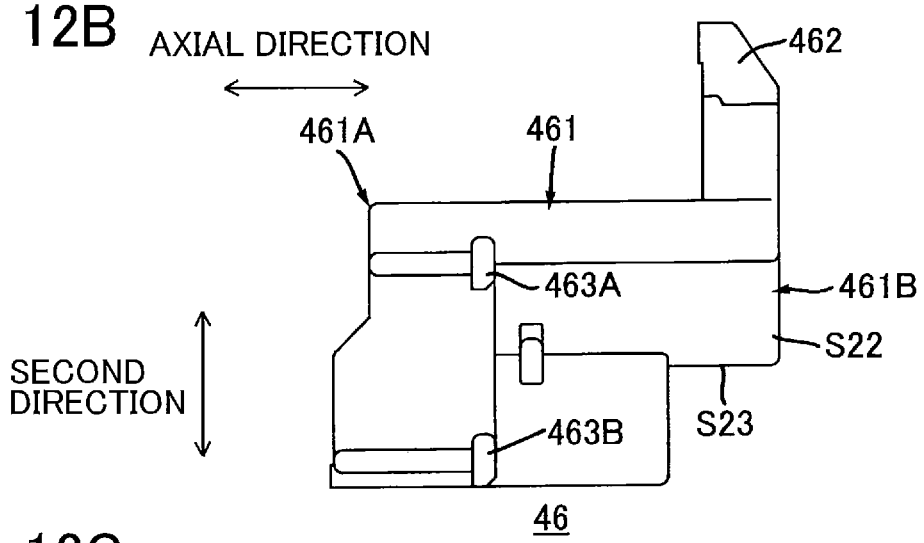
FIG. 12B is a side view of the stop member illustrated in FIG. 12A as viewed in a first direction.

As illustrated in FIG. 12B, the stop body 461 extends in the axial direction, and has a polygonal columnar shape. The stop body 461 is in contact with the first supporting surface 423A of the second side frame 422. The stop body 461 includes a rib 461A and the cam portion 461B.

Figure 12C:
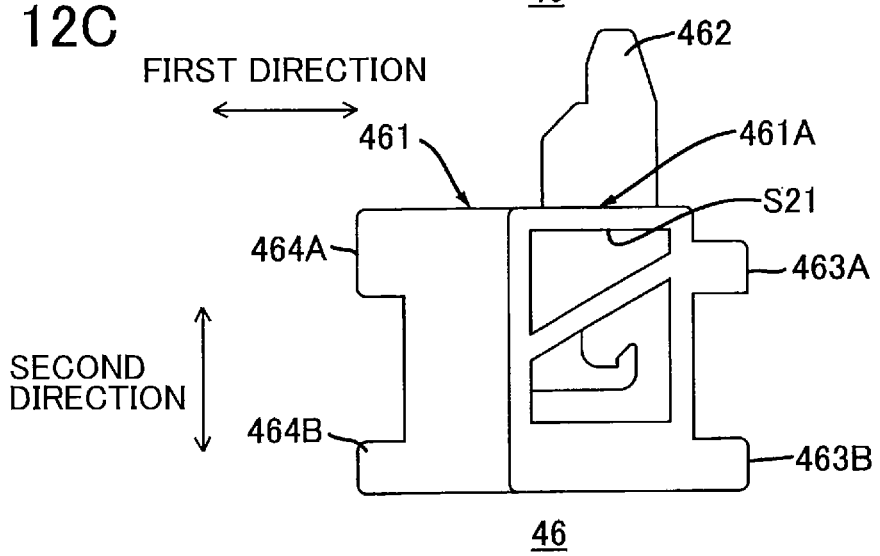
FIG. 12C is a side view of the stop member illustrated in FIG. 12A as viewed in the axial direction but opposite to the direction in FIG. 12A.

The rib 461A is positioned at one end in the axial direction of the stop body 461. As illustrated in FIG. 12C, the rib 461A extends in the first direction. The rib 461A contacts the shaft 451 of the pendulum gear 45 positioned at the separated position in the state where the stop member 46 is at the first position. Specifically, the rib 461A has a first contacting surface S21 (FIG. 12C). In other words, the stop body 461 has the first contacting surface S21. The first contacting surface S21 contacts the shaft 451 of the pendulum gear 45 positioned at the separated position in the state where the stop member 46 is at the first position.

As illustrated in FIG. 12B, the cam portion 461B is positioned at another end portion in the axial direction of the stop body 461. The cam portion 461B extends in the axial direction. As illustrated in FIG. 12A, the cam portion 461B has the sloped surface S22 and a second contacting surface S23. In other words, the stop body 461 has the sloped surface S22 and the second contacting surface S23.

Figure 11A:
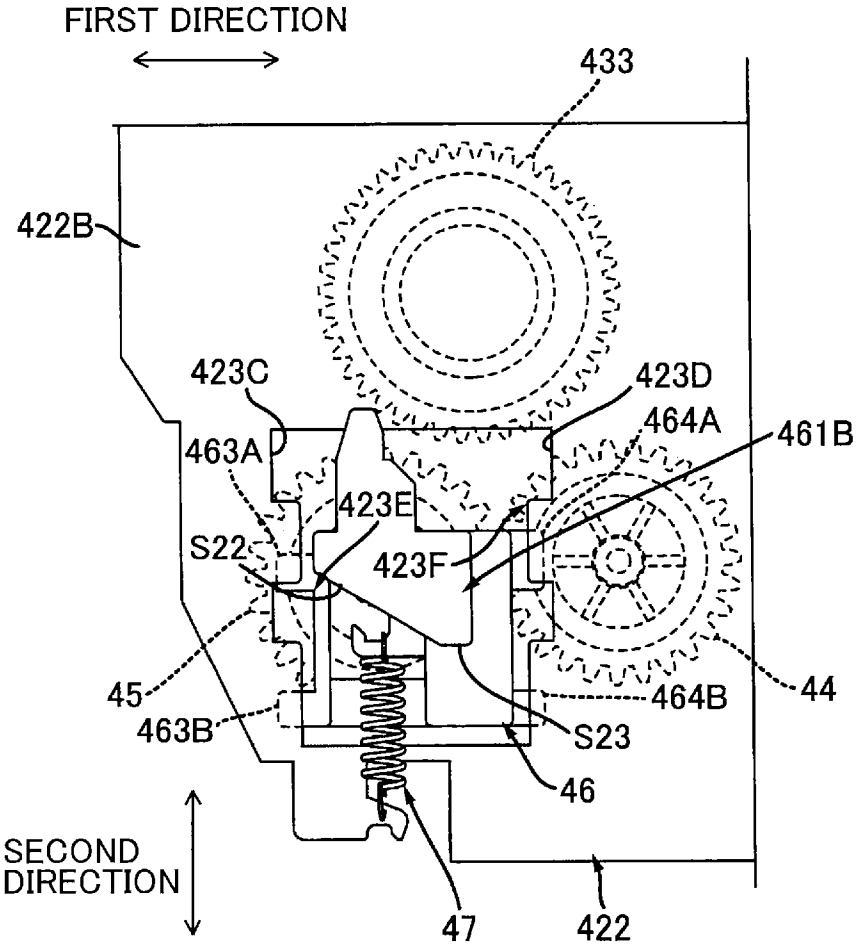
FIG. 11A is a view for description of movement of a stop member, and particularly illustrating the stop member positioned at a first position in the image forming apparatus according to the embodiment.

The sloped surface S22 is a part of the one end surface in the second direction of the cam portion 461B. the sloped surface S22 is inclined with respect to the first direction such that the sloped surface S22 is gradually distant from the first protrusion 462 in the direction from the second protrusion 463A to the third protrusion 464A. In other words, the sloped surface S22 is gradually distant from the first protrusion 462 in the direction of movement of the sheet cassette 3 from the external position (FIG. 2) to the internal position (FIG. 1). The sloped surface S22 is brought into contact with the rib 33 (FIG. 3) in accordance with the movement of the sheet cassette 3 from the external position to the internal position while the stop member 46 is at the first position (FIG. 11A).

The second contacting surface S23 is a remaining part of the one end surface in the second direction of the cam portion 461B. The second contacting surface S23 is positioned between the sloped surface S22 and the third protrusion 464A in the first direction. The second contacting surface S23 is positioned at a downstream side of the sloped surface S22 in the moving direction of the sheet cassette 3 from the external position to the internal position. The second contacting surface S23 is connected to the sloped surface S22. The second contacting surface S23 extends in the first direction. The second contacting surface S23 contacts the other surface S12 (FIG. 3) in the second direction of the rib 33 in the state where the sheet cassette 3 is at the internal position and the stop member 46 is at the second position. In FIG. 11B, an upper horizontal line of the rib 33 is the other surface S12 which is in contact with the second contacting surface S23.

3.6.2 First Protrusion

As illustrated in FIG. 12A, the first protrusion 462 extends in the second direction from the stop body 461. Specifically, as illustrated in FIG. 12B, the first protrusion 462 is positioned at another end surface in the second direction of the cam portion 461B. The first protrusion 462 extends from the other end surface in the second direction of the cam portion 461B. The first protrusion 462 is integral with the cam portion 461B. However, the first protrusion 462 may be attached to the other end surface in the second direction of the cam portion 461B. The first protrusion 462 is positioned apart from the rib 461A in the axial direction.

As illustrated in FIG. 8, the first protrusion 462 is in contact with the second supporting surface 423B of the second side frame 422. In other words, the first protrusion 462 is in contact with the second surface 422B of the second side frame 422.

3.6.3 Second Protrusions 463A, 463B

As illustrated in FIG. 12A, the second protrusion 463A is positioned on one end surface in the first direction of the stop body 461. The second protrusion 463A protrudes in the first direction from the one end surface in the first direction of the stop body 461. The second protrusion 463A is integral with the stop body 461. However, the second protrusions 463A may be attached to the one end surface of the stop body 461.

As illustrated in FIG. 11A, the second protrusion 463A protrudes from the stop body 461 toward the first guide surface 423C. The second protrusion 463A protrudes in the first direction.

As illustrated in FIG. 12B, the second protrusion 463A is positioned between the rib 461A and the cam portion 461B in the axial direction. The second protrusion 463A is positioned between the rib 461A and the first protrusion 462 in the axial direction.

As illustrated in FIG. 8, the second protrusion 463A faces the first guide rib 423E (FIG. 11A) of the second side frame 422 in the axial direction. The second protrusion 463A is positioned opposite to the sheet cassette 3 with respect to the first guide rib 423E in the axial direction in the state where the sheet cassette 3 is at the internal position. In other words, the first guide rib 423E is positioned between the second protrusion 463A and the sheet cassette 3 in the axial direction when the sheet cassette 3 is at the internal position.

Figure 13:
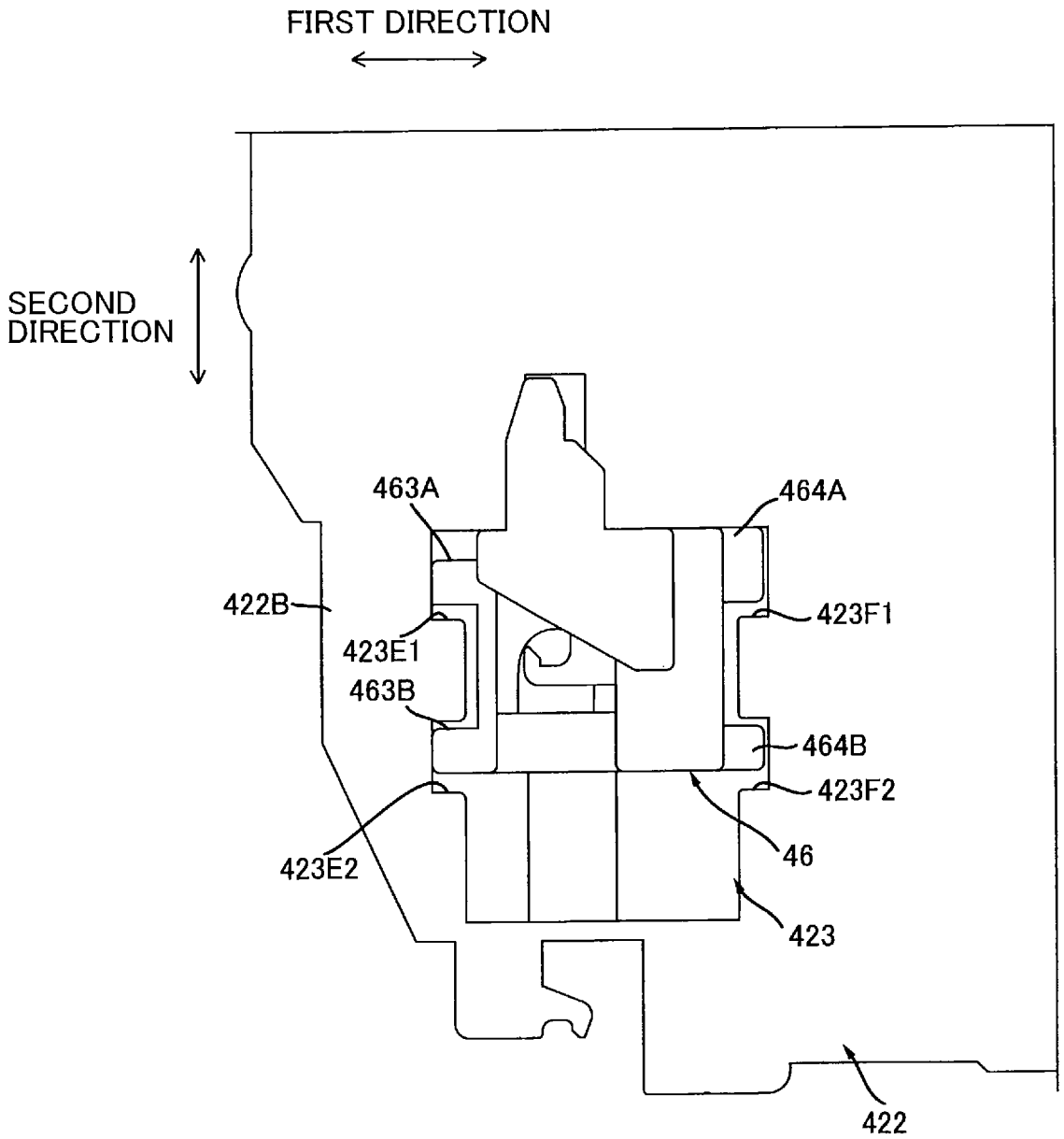
FIG. 13 is a view for description of attachment of the stop member to the second frame.

Incidentally, as illustrated in FIG. 13, when assembling the stop member 46 to the second side frame 422, the second protrusion 463A moves past the first notch 423E1 of the first guide rib 423E. In other words, the first notch 423E1 allows the second protrusion 463A to move past the first notch 423E1 when assembling the stop member 46 to the second side frame 422.

As illustrated in FIG. 12A, the second protrusion 463B is positioned apart from the second protrusion 463A in the second direction. As illustrated in FIG. 13, when assembling the stop member 46 to the second side frame 422, the second protrusion 463B moves past the first notch 423E2 of the first guide rib 423E. In other words, the first notch 423E2 allows the second protrusion 463B to move past the first notch 423E2 when assembling the stop member 46 to the second side frame 422. The second protrusion 463B is the same as the second protrusion 463A, and therefore, further description will be omitted.

3.6.4 Third Protrusions 464A, 464B

As illustrated in FIG. 12A, the third protrusion 464A is positioned on another end surface in the first direction of the stop body 461. The third protrusion 464A is positioned opposite to the second protrusion 463A with respect to the stop body 461. The third protrusion 464A protrudes in the first direction from the other end surface in the first direction of the stop body 461. The third protrusion 464A is integral with the stop body 461. However, the third protrusions 464A may be attached to the other end surface of the stop body 461.

As illustrated in FIG. 11A, the third protrusion 464A protrudes from the stop body 461 toward the second guide surface 423D. The third protrusion 464A protrudes in the first direction.

The third protrusion 464A is positioned between the rib 461A and the cam portion 461B in the axial direction, similar to the second protrusion 463A. The third protrusion 464A is positioned between the rib 461A and the first protrusion 462 in the axial direction.

The third protrusion 464A faces the second guide rib 423F of the second side frame 422 in the axial direction, similar to the second protrusion 463A. The third protrusion 464A is positioned opposite to the sheet cassette 3 with respect to the second guide rib 423F in the axial direction in the state where the sheet cassette 3 is at the internal position. In other words, the second guide rib 423F is positioned between the third protrusion 464A and the sheet cassette 3 in the axial direction when the sheet cassette 3 is at the internal position.

Incidentally, as illustrated in FIG. 13, when assembling the stop member 46 to the second side frame 422, the third protrusion 464A moves past the second notch 423F1 of the second guide rib 423F. In other words, the second notch 423F1 allows the third protrusion 464A to move past the second notch 423F1 when assembling the stop member 46 to the second side frame 422.

As illustrated in FIG. 12A, the third protrusion 464B is positioned apart from the third protrusion 464A in the second direction. As illustrated in FIG. 13, when assembling the stop member 46 to the second side frame 422, the third protrusion 464B moves past the second notch 423F2 of the second guide rib 423F. In other words, the second notch 423F2 allows the third protrusion 464B to move past the second notch 423F2 when assembling the stop member 46 to the second side frame 422. The third protrusion 464B is the same as the third protrusion 464A, and therefore, further description will be omitted.

3.7 Spring

As illustrated in FIG. 11B, the spring 47 urges the stop member 46 toward the first position from the second position. The spring 47 is a tension coil spring. The spring 47 is expandable and shrinkable in the second direction. The spring 47 has one end portion in the second direction hooked on the stop body 461, and another end portion hooked on the second side frame 422.

4. Function and Effect (1) According to the image forming apparatus 1 described above, the cam portion 461B of the stop member 46 does not press against the rib 33 in the first direction as illustrated in FIG. 11B. Therefore, the stop member 46 does not press against the sheet cassette 3 in the separating direction of the first roller 32 away from the second roller 41. As a result, the first roller 32 and the second roller 41 can stably and cooperatively convey the sheet S in the sheet cassette 3.

(2) According to the image forming apparatus 1, the first side frame 421 has the receiving surface 421B illustrated in FIG. 6. The receiving surface 421B receives the rib 33 when the sheet cassette 3 is at the internal position. With this structure, the rib 33 can be stably supported by the receiving surface 421B in the state where the sheet cassette 3 is at the internal position. Hence, the stop member 46 positioned at the second position can be stably supported by the rib 33.

(3) According to the image forming apparatus 1, as illustrated in FIG. 4, the rib 33 is provided with the protrusion 331. The protrusion 331 contacts the receiving surface 421B (FIG. 6). The rib 33 can be smoothly slidingly moved on the receiving surface 421B by the contact of the protrusion 331 with the receiving surface 421B during movement of the sheet cassette 3 between the external position and the internal position. As a result, the operator can smoothly move the sheet cassette 3.

(4) According to the image forming apparatus 1, as illustrated in FIG. 11A, the sloped surface S22 is brought into contact with the rib 33 in a case where the sheet cassette 3 is moved from the external position to the internal position while the stop member 46 is at the first position. The stop member 46 is moved from the first position (FIG. 11A) to the second position (FIG. 11B) by the pressing force from the rib 33 to the sloped surface S22 during movement of the sheet cassette 3 from the external position to the internal position. Hence, the stop member 46 can be moved from the first position to the second position by making use of the movement of the sheet cassette 3 from the external position to the internal position.

(5) According to the image forming apparatus 1, as illustrated in FIG. 11B, the second contacting surface S23 contacts the rib 33 in the state where the sheet cassette 3 is at the internal position and the stop member 46 is at the second position. The stop member 46 can be positioned at the second position by the contact between the second contacting surface S23 and the rib 33.

(6) According to the image forming apparatus 1, as illustrated in FIG. 8, the first protrusion 462 of the stop member 46 contacts the second surface 422B of the second side frame 422. The contact between the second surface 422B and the first protrusion 462 prevents the stop member 46 from moving in the axial direction when the stop member 46 is moving between the first position and the second position. Hence, the stop member 46 can be stably moved in the second direction.

(7) According to the image forming apparatus 1, as illustrated in FIGS. 11A and 11B, the first guide surface 423C and the second guide surface 423D can prevent the stop member 46 from moving in the first direction when the stop member 46 is moving between the first position and the second position. Hence, the stop member 46 can be stably moved in the second direction.

(8) According to the image forming apparatus 1, as illustrated in FIG. 8, the first guide rib 423E is positioned between the second protrusion 463A and the sheet cassette 3 in the axial direction in the state where the sheet cassette 3 is at the internal position. Similarly, the second guide rib 423F is positioned between the third protrusion 464A and the sheet cassette 3 in the axial direction in the state where the sheet cassette 3 is at the internal position. The first guide rib 423E and the second guide rib 423F can prevent the stop member 46 from moving in the axial direction when the stop member 46 is moving between the first position and the second position. Hence, the stop member 46 can be stably moved in the second direction.

While the description has been made in detail with reference to the specific embodiment, it would be apparent to those skilled in the art that various changes and modifications may be made therein without departing from the scope of the disclosure.

What is claimed is:

1. An image forming apparatus comprising:

a housing;

a sheet cassette movable in a first direction between an internal position and an external position, the sheet cassette comprising:

a sheet accommodating portion configured to accommodate therein a sheet, the sheet accommodating portion being positioned inside the housing in a state where the sheet cassette is at the internal position, the sheet accommodating portion being positioned outside the housing in a state where the sheet cassette is at the external position; and a first roller;

a second roller contacting the first roller in the state where the sheet cassette is at the internal position and configured to convey the sheet positioned in the sheet cassette in cooperation with the first roller;

a gear train comprising a gear rotatable together with the second roller;

a pendulum gear movable between a meshing position where the pendulum gear is in meshing engagement with the gear train and a separated position where the pendulum gear is separated away from the gear train; and a stop member configured to be moved linearly from a first position to a second position in a second direction crossing the first direction by being pressed by a part of the sheet cassette moving from the external position to the internal position, the stop member being at the first position in the state where the sheet cassette is at the external position, the stop member retaining the pendulum gear at the separated position in a state where the stop member is at the first position, the stop member allowing the pendulum gear to move from the separated position to the meshing position in a state where the stop member is at the second position;

wherein, in a state where the sheet cassette is at the internal position and the stop member is at the second position, the stop member is out of contact with the part of the sheet cassette in the first direction but contacts the part of the sheet cassette in the second direction.

2. The image forming apparatus according to claim 1, further comprising a spring configured to urge the stop member from the second position toward the first position in the second direction.

3. The image forming apparatus according to claim 1, wherein the part of the sheet cassette is a rib pressing against the stop member in accordance with the movement of the sheet cassette from the external position to the internal position.

4. The image forming apparatus according to claim 3, wherein the first roller is rotatable about a roller axis extending in an axial direction; and wherein the rib is positioned at a side surface in the axial direction of the sheet cassette.

5. The image forming apparatus according to claim 4, further comprising a first frame facing the side surface in the axial direction in the state where the sheet cassette is at the internal position;

wherein the first frame has a receiving surface receiving the rib in the state where the sheet cassette is at the internal position.

6. The image forming apparatus according to claim 5, wherein the rib extends in the first direction, and a protrusion protrudes from the rib in the second direction and is configured to contact the receiving surface in the state where the sheet cassette is at the internal position.

7. The image forming apparatus according to claim 3, wherein the rib extends in the first direction.

8. The image forming apparatus according to claim 3, wherein the stop member comprises a stop body having a first contacting surface, the first contacting surface contacting the pendulum gear positioned at the separated position in the state where the stop member is at the first position.

9. The image forming apparatus according to claim 8, wherein the stop body further has a sloped surface inclined with respect to the first direction, the sloped surface being brought into contact with the rib in accordance with the movement of the sheet cassette from the external position to the internal position in the state where the stop member is at the first position.

10. The image forming apparatus according to claim 9, wherein the stop body further has a second contacting surface extending in the first direction, the second contacting surface contacting the rib in the state where the sheet cassette is at the internal position and the stop member is at the second position.

11. The image forming apparatus according to claim 10, wherein the first roller is rotatable about a roller axis extending in an axial direction, wherein the image forming apparatus further comprises a second frame supporting the stop member, the second frame having:

a first surface positioned apart from the sheet cassette in the axial direction in the state where the sheet cassette is at the internal position; and a second surface positioned between the first surface and the sheet cassette in the axial direction in the state where the sheet cassette is at the internal position;

wherein the stop member comprises a first protrusion extending in the second direction from the stop body and contacting the second surface of the second frame.

12. The image forming apparatus according to claim 11, wherein the second frame has:

a first guide surface extending in the second direction and configured to guide one end in the first direction of the stop member during movement of the stop member between the first position and the second position; and a second guide surface extending in the second direction and positioned opposite to the first guide surface in the first direction with respect to the stop member, the second guide surface being configured to guide another end in the first direction of the stop member during movement of the stop member between the first position and the second position.

13. The image forming apparatus according to claim 12, wherein the stop member further comprises:

a second protrusion protruding from the stop body toward the first guide surface; and a third protrusion protruding from the stop body toward the second guide surface.

14. The image forming apparatus according to claim 13, wherein the second frame comprises:

a first guide rib positioned on the first guide surface and extending in the second direction, the first guide rib being positioned between the second protrusion and the sheet cassette in the axial direction in the state where the sheet cassette is at the internal position; and a second guide rib positioned on the second guide surface and extending in the second direction, the second guide rib being positioned between the third protrusion and the sheet cassette in the axial direction in the state where the sheet cassette is at the internal position.

15. The image forming apparatus according to claim 14, wherein the first guide rib has a first notch allowing the second protrusion to move past the first notch when assembling the stop member to the second frame;

wherein the second guide rib has a second notch allowing the third protrusion to move past the second notch when assembling the stop member to the second frame.

16. The image forming apparatus according to claim 1, wherein the housing includes a guide surface extending linearly in the second direction and configured to guide the stop member to linearly move in the second direction between the first position and the second position.

17. An image forming apparatus comprising:

a housing;

a sheet cassette movable in a first direction between an internal position and an external position, the sheet cassette comprising:

a sheet accommodating portion configured to accommodate therein a sheet, the sheet accommodating portion being positioned inside the housing in a state where the sheet cassette is at the internal position, the sheet accommodating portion being positioned outside the housing in a state where the sheet cassette is at the external position; and a first roller;

a second roller contacting the first roller in the state where the sheet cassette is at the internal position and configured to convey the sheet positioned in the sheet cassette in cooperation with the first roller;

a gear train comprising a gear rotatable together with the second roller;

a pendulum gear movable between a meshing position where the pendulum gear is in meshing engagement with the gear train and a separated position where the pendulum gear is separated away from the gear train; and a stop member configured to be moved from a first position to a second position in a second direction crossing the first direction by being pressed by a part of the sheet cassette moving from the external position to the internal position, the stop member being at the first position in the state where the sheet cassette is at the external position, the stop member retaining the pendulum gear at the separated position in a state where the stop member is at the first position, the stop member allowing the pendulum gear to move from the separated position to the meshing position in a state where the stop member is at the second position;

wherein, in a state where the sheet cassette is at the internal position and the stop member is at the second position, the stop member is out of contact with the part of the sheet cassette in the first direction but contacts the part of the sheet cassette in the second direction, wherein the part of the sheet cassette is a rib pressing against the stop member in accordance with the movement of the sheet cassette from the external position to the internal position, wherein the stop member comprises a stop body having a first contacting surface, the first contacting surface contacting the pendulum gear positioned at the separated position in the state where the stop member is at the first position, wherein the stop body further has a sloped surface inclined with respect to the first direction, the sloped surface being brought into contact with the rib in accordance with the movement of the sheet cassette from the external position to the internal position in the state where the stop member is at the first position, and wherein the stop body further has a second contacting surface extending in the first direction, the second contacting surface contacting the rib in the state where the sheet cassette is at the internal position and the stop member is at the second position.

* * * * *